US005961689A

United States Patent [19]

Kobayashi et al.

[11] Patent Number: 5,961,689

[45] Date of Patent: Oct. 5, 1999

[54] METHOD OF PROTECTIVE ATMOSPHERE HEATING

[75] Inventors: Hisashi Kobayashi, Putnam Valley; Arthur Wellington Francis, Jr., Monroe; Xueping Li, Somers, all of N.Y.

[73] Assignee: Praxair Technology, Inc., Danbury, Conn.

[21] Appl. No.: 09/033,608

[22] Filed: Mar. 3, 1998

[51] Int. Cl.[6] ..... C21B 13/00; C22B 21/00; C22B 26/00

[52] U.S. Cl. ..... 75/414; 75/10.45; 75/594; 75/654; 75/686; 75/687; 266/901; 373/22

[58] Field of Search ..... 75/594, 686, 709, 75/672, 414, 10.45, 654, 687; 266/901; 373/22, 8

[56] References Cited

U.S. PATENT DOCUMENTS

| | | | |
|---|---|---|---|
| 3,809,378 | 5/1974 | Iida | 266/33 |
| 4,010,935 | 3/1977 | Stephens | 266/901 |
| 4,327,901 | 5/1982 | Kaiser | 266/217 |
| 4,657,586 | 4/1987 | Masterson et al. | 75/76 |
| 4,699,654 | 10/1987 | Maddever et al. | 75/10.45 |
| 4,796,277 | 1/1989 | Maddever et al. | 373/72 |
| 5,211,744 | 5/1993 | Areaux et al. | 75/594 |
| 5,421,856 | 6/1995 | Lazcano-Navarro | 75/672 |
| 5,563,903 | 10/1996 | Jebrail et al. | 373/22 |
| 5,609,481 | 3/1997 | Kobayashi | 432/22 |

*Primary Examiner*—Melvyn Andrews
*Assistant Examiner*—Tima McGuthry-Banks
*Attorney, Agent, or Firm*—Stanley Ktorides

[57] ABSTRACT

A method for heating and/or melting a charge such as aluminum in a furnace using heat generated by combustion to radiatively heat the charge through a layer of protective gas wherein combustion reaction products generated by the combustion are exhausted from a lower level within the furnace, and, during melting, the protective gas layer has a higher upper boundary than during a subsequent heating period, enabling reduced $NO_x$ generation, lower fuel and oxygen consumption and reduced refractory corrosion by avoiding furnace gas flow through the high temperature upper furnace region.

11 Claims, 2 Drawing Sheets

METHOD OF PROTECTIVE ATMOSPHERE HEATING

TECHNICAL FIELD

This invention relates generally to heating and/or melting a charge such as aluminum.

BACKGROUND ART

Often in the operation of industrial furnaces it is desired that heat be provided to a furnace charge such as aluminum within the furnace for heating and/or melting the charge. While the heat may be generated by a number of means, such as by electric resistance coils, it is generally more economical to generate the heat by the combustion of fuel with oxidant. Until recently, air has been the preferred oxidant because of its low cost. However, many industrial furnaces have switched or will soon switch to an oxidant having a higher oxygen concentration than that of air in order to take advantage of the improved energy efficiency and the environmental benefits attainable with such oxy-fuel combustion.

The use of combustion to generate heat for heating a charge may have a deleterious effect on the charge. Those skilled in the art have addressed this potential problem by providing a protective atmosphere over the charge surface between the furnace charge and the combustion reaction. The combustion gases are exhausted from the furnace from above the combustion reaction so as to ensure that the combustion gases stay well removed from the charge surface. One important recent development in this area is disclosed and claimed in U.S. Pat. No. 5,563,903—Jebrail et al.

While this conventional protective atmosphere heating arrangement has provided acceptable results when the height of the top surface of the charge is low relative to the burner height or when the charge is molten, there has been experienced relatively high levels of $NO_x$ generation with this system. Moreover, the fuel and oxidant consumption is relatively high and potential corrosion of refractory walls and burner parts within the furnace is a concern.

Accordingly, it is an object of this invention to provide a method for providing heat to a large volume of furnace charge using combustion with a protective atmosphere therebetween which enables the reduced generation of nitrogen oxides ($NO_x$).

It is another object of this invention to provide a method for providing heat to a furnace charge using oxy-fuel combustion with a protective atmosphere therebetween which enables the reduced consumption of fuel and oxidant.

It is a further object of this invention to provide a method for providing heat to a furnace charge using combustion with a protective atmosphere therebetween which enables the furnace to operate with a reduced level of refractory corrosion.

SUMMARY OF THE INVENTION

The above and other objects, which will become apparent to those skilled in the art upon a reading of this disclosure, are attained by the present invention, one aspect of which is:

A method for providing heat to a furnace charge contained in a furnace having a floor comprising:

(A) providing fuel and oxidant into the furnace and combusting the fuel and oxidant within the furnace generating heat and combustion reaction products and forming a combustion layer within the furnace, at least one of said fuel and oxidant being provided into the furnace at a first vertical distance above the floor;

(B) providing protective gas into the furnace at a second vertical distance above the floor, said second vertical distance being less than the first vertical distance, and forming a protective gas layer within the furnace between at least some of the furnace charge and the combustion layer;

(C) radiating heat from the combustion layer through the protective layer and to the furnace charge; and (D) withdrawing the combustion reaction products from the furnace from below the first vertical distance.

Another aspect of the invention is:

A method for providing heat to a furnace charge contained in a furnace having a floor, comprising:

(A) providing fuel and oxidant into a furnace and combusting the fuel and oxidant within the furnace generating heat and combustion reaction products and forming a combustion layer within the furnace, at least one of said fuel and oxidant being provided into the furnace at a first vertical distance above the floor;

(B) providing protective gas into the furnace at a second vertical distance above the floor, said second vertical distance being less than the first vertical distance, and forming a protective gas layer within the furnace between at least some of the furnace charge and the combustion layer;

(C) radiating heat from the combustion layer through the protective layer and to the furnace charge during a two portion cycle having a first melting portion and a second flat bath portion wherein the protective layer has an upper boundary above the floor during the melting portion which is higher than the upper boundary of the protective layer during the flat bath portion; and (D) withdrawing the combustion reaction products from the furnace from at or above the second vertical distance.

Figure 1:
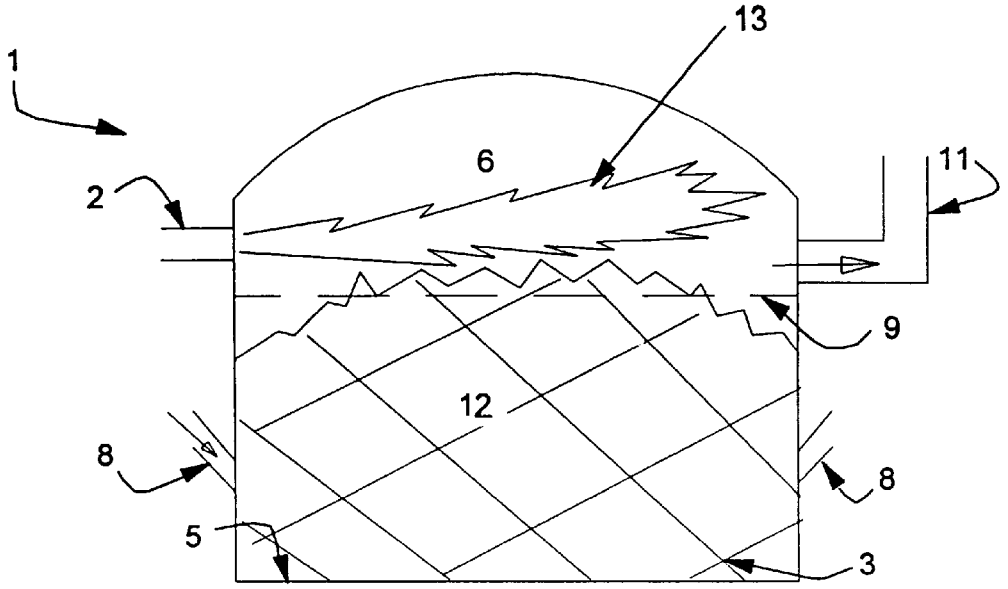
FIG. 1 is a simplified cross-sectional representation of one embodiment of an aluminum melting furnace illustrating the method of this invention during the initial portion of the melting cycle after the furnace has been charged with a large amount of scrap aluminum materials.

The numerals in the Drawings are the same for the common elements.

DETAILED DESCRIPTION

The invention incorporates the discovery that certain unexpected advantages are attained when a large volume of material is charged into a furnace employing a protective atmosphere, or if the combustion gases generated by combustion in a furnace employing a protective atmosphere between the charge and the combustion reaction are exhausted from the furnace below the conventional exhaust level which has heretofore been considered necessary for achieving the requisite protection of the furnace charge. These unexpected advantages are a higher level of the protective atmosphere covering most of the furnace charge during melting, a lower level of $NO_x$ generation, a reduced consumption of fuel and oxidant, and a reduced level of furnace refractory corrosion. Each of these advantages provides significant utility to the invention and together they provide a very significant advancement to industrial heating and melting practice.

The invention is practiced in a furnace which contains a furnace charge which is to be heated and/or melted. Examples of a furnace charge which may be employed in the practice of this invention include aluminum, steel, lead, zinc, magnesium, glass and glassmaking materials. The invention will be discussed in greater detail with reference to FIGS. 1 and 2.

Figure 2:
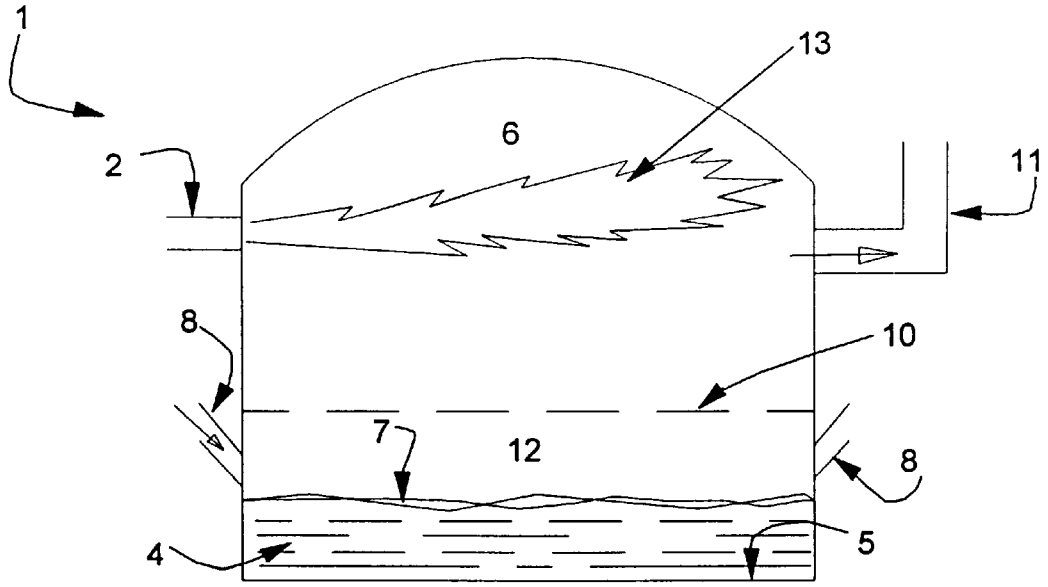
FIG. 2 is a simplified cross-sectional representation of the same aluminum melting furnace during the flat bath period of the melting cycle after the furnace charge has been substantially completely melted.

Fuel and oxidant are provided into the furnace 1, from sources of fuel and oxidant (not shown), typically near the roof above the top of the furnace charge, such as through a burner 2. In some instances, such as in the operation of a round roof top charged aluminum melting furnace shown in FIGS. 1 and 2, the unmelted charge 3 may initially fill virtually the entire furnace and even occupy space above the fuel and oxidant injection points prior to the start of the melting cycle. This is illustrated in FIG. 1. In some melting practices, a certain depth of molten aluminum is left in the furnace from the previous melting cycle, known as a heel, and a new charge is placed in the furnace. As the charge is melted, the height of the charge decreases and a flat bath 4 is achieved when most of the charge is melted. The flat bath condition is illustrated in FIG. 2.

In conventional melting of an aluminum charge, it is believed that most of dross is formed during the melting of solid charge to form a flat bath. The solid aluminum charge has a large total surface area, especially when light scrap such as used beverage cans is used as the charge material. During melting of the scrap aluminum, many fresh liquid droplets and surfaces are formed, causing oxidation to take place in contact with the furnace atmosphere which contains oxidizing species. Melting typically starts from the top of the charge and molten aluminum flows down and re-solidifies upon contacting colder charge material in the lower elevation. As the charge gradually melts down, this melting-resolidification process repeats, resulting in the creation of many fresh liquid surface areas, and hence a large amount of dross, e.g. aluminum oxide and aluminum metal mixture. Once the flat bath condition is achieved the total surface area exposed to the furnace atmosphere is relatively small. It is estimated that as much as 70 to 90 percent of the dross is formed during the initial melting period prior to the flat bath condition.

In the practice of this invention, the protective atmosphere layer is higher during the initial melting portion of the cycle, when most of the furnace volume contains aluminum charge, than during the flat bath portion of the cycle. This surprising effect is believed to be caused by the strong vertical temperature gradient and the injection of ambient temperature nitrogen protective gas at a low velocity above but near the level of the furnace where the subsequent flat bath will have its upper surface. The low temperature nitrogen gas flows down due to the buoyancy effect and fills the void space in between the pieces of aluminum scrap and then moves upward. Since a significant fraction of the furnace volume is occupied by the charge materials, the average upward velocity of the nitrogen is increased. In addition, the charge materials act as a physical barrier to mixing by inhibiting any recirculation flow.

In the discussion of the invention regarding the vertical elevations above the bottom or floor 5 of the furnace, such elevations or distances are with respect to the highest point of the furnace floor to the highest point of the burner port, oxygen lance port, protective gas injector port, or flue gas exhaust port.

The fuel and oxidant may be provided into the furnace together such as from a pre-mixed or post-mixed burner or they may be provided into the furnace separately such as through separate fuel and oxygen lances, which are in flow communication with sources of fuel and oxidant. The fuel and oxidant may be provided into the furnace using a single burner or using a plurality of burners. At least one of the fuel and oxidant, and preferably both of the fuel and oxidant, are provided into the furnace at a first vertical distance above the floor 5 so that the subsequent combustion reaction is kept from approaching the top surface of the charge during the bulk of the melting and/or heating cycle. This first vertical distance is typically within the range of from 0.1 to 2 times the narrowest width of the furnace.

The fuel may be any fluid fuel capable of combusting within a furnace to generate heat. Among such fuels one can name methane, natural gas, oil and hydrogen.

The oxidant is a fluid comprising at least 15 mole percent oxygen. Preferably the oxidant has an oxygen concentration of at least 30 mole percent, most preferably at least 90 mole percent. The oxidant may be commercially pure oxygen having an oxygen concentration of at least 99.5 mole percent. Typically the balance of the oxidant is comprised primarily of nitrogen. The oxidant may be a mixture of air, commercial oxygen and recycled flue gas.

The fuel and the oxidant combust within the furnace generating heat and combustion reaction products. The combustion reaction products include products of complete combustion such as carbon dioxide and water vapor, and may include products of incomplete combustion such as carbon monoxide, unburned fuel, unreacted oxygen and nitrogen. The combustion reaction and the resulting combustion reaction products form a combustion layer 6 within the furnace. Most of the combustion reactions take place in the visible flame region 13 above the top surface of the furnace charge typically at and above the first vertical distance and the combustion layer 6 extends below the first vertical distance due to natural mixing with protective gas introduced below.

Protective gas is provided into the furnace through one or more injectors 8 close to and above the eventual flat bath upper surface level 7 of the charge at a second vertical distance above the floor 5, which is less than the first vertical distance, and is typically within the range of from 0.01 to 0.75 times the narrowest width of the furnace. Injectors 8 are in flow communication with a source of protective gas (not shown). The protective gas forms a protective gas layer 12 within the furnace, including the void spaces within the pile of charge materials, between the floor and the combustion layer 6, thus protecting most or all of the furnace charge from the combustion reaction products. The protective gas layer serves as a physical barrier to keep combustion reaction products from contacting and harming the furnace charge. The protective gas layer has a height or upper boundary 9 during the melting portion of the cycle which is higher than its height or upper boundary 10 during the flat bath portion of the cycle. This upper boundary of the protective gas layer falls as the charge is melted during the melting portion of the cycle. The composition of the protective gas will vary depending upon what particular gas is needed to protect a particular furnace charge. Generally the protective gas will comprise nitrogen. Other gases which may be used to make up the protective gas include oxygen, argon and natural gas. Mixtures comprising two or more components may also be used to make up the protective gas. When reactive gas such as oxygen is used in the protective gas, the protective gas is intended to cause a favorable reaction with the charge.

Conventional oxy-fuel combustion is carried out at a relatively high velocity to ensure good mixing of the fuel and oxidant so as to avoid localized hot spots and relatively high levels of $NO_x$ generation. However, in the practice of this invention, it is imperative that the combustion gas layer, as well as the protective gas layer, pass through the furnace at relatively low velocities so as to avoid excessive turbulence which would cause significant intermixing of the two layers resulting in adulteration of the protective gas layer with a concomitant loss of the protective capability of the protective gas layer. Accordingly, the fuel and oxidant are provided into the furnace so that the gases in the ensuing combustion reaction have an inlet mass flux weighted average velocity of not more than 120 feet per second (fps), preferably not more than 50 fps, most preferably not more than 30 fps, and the protective gas is provided into the furnace so that the protective gas layer is introduced to the furnace at an average velocity of not more than 120 fps, preferably not more than 50 fps most preferably not more than 30 fps. The inlet mass flux weighted average velocity is calculated by dividing the sum of the mass flux of fuel input to the furnace times the average fuel velocity at the fuel nozzles and the mass flux of the oxidant input to the furnace times the average oxidant velocity at the oxidant nozzles by the sum of the mass flux of fuel input to the furnace and the mass flux of oxidant.

Heat generated by the combustion of fuel and oxidant within the furnace is radiated directly from the flame region 13, or indirectly from the combustion layer 6 by reradiation from the furnace roof and walls, through the protective layer 12 and to the furnace charge wherein it serves to heat and/or melt the furnace charge. While the protective gas layer 12 acts as a physical barrier in order to protect the charge from material contact, the protective gas layer is essentially invisible to heat energy passing by radiation, especially if the protective gas layer is composed largely of nitrogen, argon or oxygen. Accordingly, heat generated by the combustion of the fuel and oxidant is efficiently transferred to the furnace charge by the radiative mode of heat transfer through the protective gas layer.

The furnace 1 has a flue or exhaust port 11 communicating with the internal volume of the furnace for withdrawing the combustion reaction products from the furnace. Preferably the protective gas is also withdrawn from the furnace through this flue or exhaust port. The aforesaid communication with the furnace interior is such that the combustion reaction products, preferably substantially all the combustion reaction products, which are exhausted from the furnace interior are withdrawn from the furnace from below the first vertical distance and preferably from above the second vertical distance. In order to avoid unwanted turbulence within the furnace, the combustion reaction products are withdrawn from the furnace at a low velocity of not more than 150 fps, and generally within the range of from 10 to 60 fps.

While not wishing to be held to any theory, applicants believe that the unexpected beneficial results experienced with the practice of this invention flow from the exaggerated temperature gradient which characterizes a furnace operating with stratified layers of combustion and protective gas. While some vertical temperature gradient may be expected in the operation of any furnace due to the tendency of heat to rise, in a conventionally operated furnace with the furnace gases in turbulent flow with consequent intermixing, heat differences between levels within the furnace tend to be significantly reduced and the temperature within the furnace largely equilibrated. In contrast, with a stratified layer furnace, the lack of turbulence and furnace gas intermixing enables a significant vertical temperature gradient to form such that there may be a difference of from 200 to as much as 1500 degrees Fahrenheit between the temperature at the lower level of the furnace and the temperature at the upper level of the furnace. Conventional stratified layer furnace practice exhausts the combustion reaction products from a high point in the furnace so as to ensure that these combustion reaction products are not brought into proximity with the furnace charge. However, this logical operating scheme unwittingly brings gas flow into the very high temperature region of the furnace. This has had a number of unfortunate consequences. First, this has brought nitrogen, such as from the oxidant or from the protective gas, and unreacted oxygen into the high temperature region wherein the high temperature kinetically favors their reaction to form $NO_x$. Second, the high temperature at the exhaust point results in a significant additional heat loss from the furnace requiring combustion of additional fuel and oxidant to make up this additional heat loss. Third, the flow of protective gas into the upper furnace region resulting from the gas exhaust in this region brings with it corrosive species such as fluxing gases originating from the furnace charge, which, at these very high temperatures, excessively corrode the furnace refractory or burner/lance nozzles at the upper level and roof of the furnace when these corrosive species contact the refractory or the burner/lance nozzles at these upper levels. All of these deleterious effects are mitigated by the practice of this invention wherein some and preferably all of the combustion gases are exhausted from the furnace from below the level that fuel and oxidant are provided into the furnace.

To further illustrate the invention and to demonstrate the advantages obtained by the practice of the invention over conventional practice, the following examples and comparative examples are presented. The examples are presented for illustrative purposes and are not intended to be limiting. The examples will be resented with reference to FIGS. 3 and 4.

Figure 3:
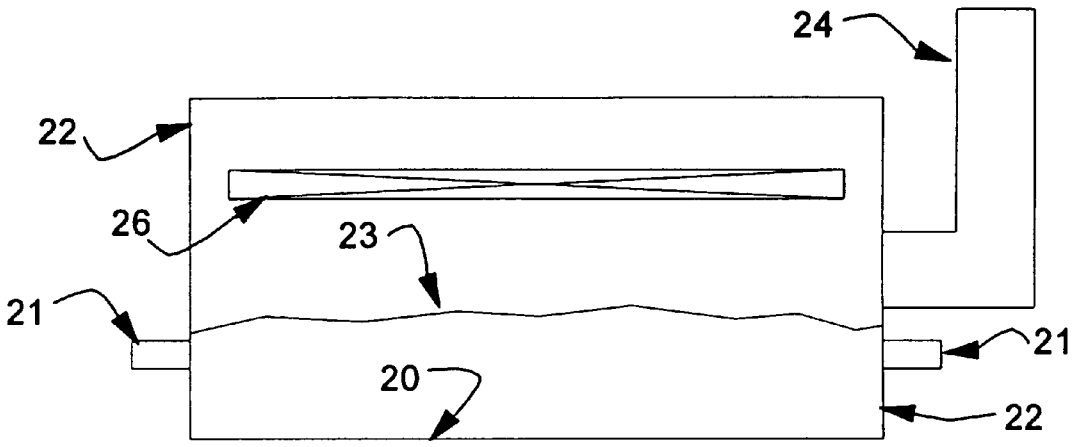
FIG. 3 is a simplified cross-sectional representation of one embodiment of a test furnace used to illustrate the method of this invention.
Figure 4:
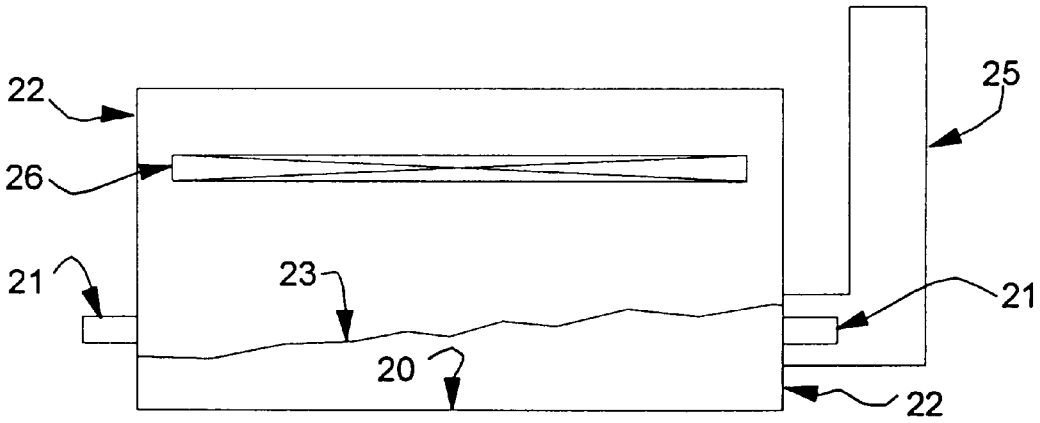
FIG. 4 is a simplified cross-sectional representation of another embodiment of a test furnace used to illustrate the method of this invention.

Examples A and B were carried out using the test furnace arrangements illustrated respectively in FIGS. 3 and 4. Each furnace had inside dimensions of a width of 6 feet, a length of 12 feet and a height of 6 feet, and had water cooled heat sink tubes on the floor 20 to simulate a furnace charge. Two sets of oxy-fuel burner systems 26 were placed on opposing side walls at a first vertical distance of about 4.5 feet above the floor 20. The burners provided natural gas at a flowrate of 3000 standard cubic feet per hour (SCFH) and commercially pure oxygen at a flowrate of 6090 SCFH into the furnace for combustion and formed a combustion layer. The average fuel velocity at the fuel nozzles was 38.2 fps and the average oxygen velocity at the oxygen nozzles was 19.4 fps, which provided a mass flux weighted average velocity of about 23 fps at the burner nozzles. Nitrogen gas was provided into the furnace through six injectors 21 (three in each end wall 22) at a second vertical distance of about 1.75 feet above the floor 20 at a total flow rate of 6000 SCFH to form a protective gas layer having a boundary shown at 23 which flowed at a velocity of about 1.4 fps. The boundary 23 is defined as the boundary surface where the concentration of nitrogen is greater than 95 volume percent. Combustion reaction products were withdrawn from the furnace through flue 24 (Example A) located about 3.4 feet (3 feet to the port axis) above floor 20, and through flue 25 (Example B) located about 1.5 feet above floor 20, and at a velocity of about 22 fps. Measurements of nitrogen concentration and carbon dioxide concentration were taken at heights of 3 feet and 1.5 feet above the floor and $NO_x$ measurements were taken in the flue. The results for Examples A and B are presented in Table 1. The furnace wall and roof temperature distribution was measured with 20 thermocouples. The representative wall temperature near each flue location is also shown in Table 1. The flue gas temperature is estimated to be typically 100 to 300° F. above the wall temperature near the flue port.

For comparative purposes, comparative examples C and D were carried out using similar test equipment and using conventional practice. In comparative example C the combustion gases were exhausted through the flue from the roof of the test furnace and in comparative example D the combustion gases were exhausted from the flue at slightly above the level of the burners, i.e. at slightly above the first vertical distance. The results from these two comparative examples are also shown in Table 1.

TABLE 1

| | A | B | C | D |
|---|---|---|---|---|
| Flue Elevation (ft) | 3.4 | 1.9 | 6 | 4.9 |
| Burner Elevation (ft) | 4.5 | 4.5 | 4.5 | 4.5 |
| Nitrogen Injection Elevation (ft) | 1.75 | 1.75 | 1.75 | 1.75 |
| Avg $N_2$ Concentration at 3 ft Elevation, % | 31.9 | 12.24 | 99 | 93.6 |
| Avg $N_2$ Concentration at 1.5 ft Elevation, % | 97.9 | 52.6 | 99 | 99 |
| Avg $CO_2$ Concentration at 3 ft Elevation, % | 14.92 | 27.5 | 0.05 | 1.77 |
| Avg $CO_2$ Concentration at 1.5 ft Elevation, % | 0.13 | 12.2 | 0 | 0.05 |
| $NO_x$ in the flue, lbm/mmbtu | 0.019 | 0.018 | 0.026 | 0.028 |
| Wall Temperature Near Flue Port, ° F. | 1,860 | 1,690 | 1,971 | 1,922 |

As can be seen from the results reported in Table 1, the use of the method of this invention enabled the operation of a stratified layer furnace with significantly lower $NO_x$ generation than that possible with conventional stratified layer furnace practice. The wall temperatures near the flue ports indicate the significant reduction in flue gas temperature and the consequent higher energy efficiency attainable with the practice of this invention. Moreover, the much lower nitrogen concentrations at the 3 foot elevation with the practice of this invention demonstrates the significant reduction of gases originating from the protective layer mixing into the combustion layer serving to reduce the concentration of corrosive gases in the upper combustion space of the furnace.

We claim:

1. A method for providing heat to a furnace charge contained in a furnace having a floor, comprising:

(A) providing fuel and oxidant into a furnace and combusting the fuel and oxidant within the furnace generating heat and combustion reaction products and forming a combustion layer within the furnace, at least one of said fuel and oxidant being provided into the furnace at a first vertical distance above the floor;

(B) providing protective gas into the furnace at a second vertical distance above the floor, said second vertical distance being less than the first vertical distance, and forming a protective gas layer within the furnace between at least some of the furnace charge and the combustion layer;

(C) radiating heat from the combustion layer through the protective layer and to the furnace charge; and (D) withdrawing the combustion reaction products from the furnace from below the first vertical distance.

2. The method of claim 1 wherein the heat is radiated through the protective layer to the furnace charge during a two portion cycle having a first melting portion and a second flat bath portion, and wherein the protective layer has an upper boundary above the floor during the melting portion which is higher than the upper boundary of the protective layer during the flat bath portion.

3. The method of claim 1 wherein the fuel and oxidant are provided together into the furnace.

4. The method of claim 1 wherein the protective gas comprises nitrogen.

5. The method of claim 1 wherein the combustion reaction products are withdrawn from the furnace at about the level of the second vertical distance.

6. The method of claim 1 wherein the combustion reaction products are withdrawn from the furnace at a velocity not more than 150 feet per second.

7. The method of claim 1 wherein the protective gas is withdrawn from the furnace with the combustion reaction products.

8. The method of claim 1 wherein the furnace charge comprises aluminum.

9. The method of claim 1 wherein the furnace charge comprises at least one from the group consisting of steel, lead, zinc, magnesium and glass.

10. A method for providing heat to a furnace charge contained in a furnace having a floor, comprising:

(A) providing fuel and oxidant into a furnace and combusting the fuel and oxidant within the furnace generating heat and combustion reaction products and forming a combustion layer within the furnace, at least one of said fuel and oxidant being provided into the furnace at a first vertical distance above the floor;

(B) providing protective gas into the furnace at a second vertical distance above the floor, said second vertical distance being less than the first vertical distance, and forming a protective gas layer within the furnace between at least some of the furnace charge and the combustion layer;

(C) radiating heat from the combustion layer through the protective layer and to the furnace charge during a two portion cycle having a first melting portion and a second flat bath portion wherein the protective layer has an upper boundary above the floor during the melting portion which is higher than the upper boundary of the protective layer during the flat bath portion; and (D) withdrawing the combustion reaction products from the furnace from at or above the second vertical distance.

11. A method for providing heat to a furnace charge contained in a furnace having a floor, comprising:

(A) providing fuel and oxidant into a furnace and combusting the fuel and oxidant within the furnace generating heat and combustion reaction products and forming a combustion layer within the furnace, at least one of said fuel and oxidant being provided into the furnace at a first vertical distance above the floor;

(B) providing protective gas into the furnace at a second vertical distance above the floor, said second vertical distance being less than the first vertical distance, and forming a protective gas layer within the furnace between at least some of the furnace charge and the combustion layer;

(C) radiating heat from the combustion layer through the protective layer and to the furnace charge; and (D) withdrawing the combustion reaction products from the furnace from below the first vertical distance and above the second vertical distance.

* * * * *